United States Patent [19]

Smid et al.

[11] 4,395,871

[45] Aug. 2, 1983

[54] PROCESS FOR THE MANUFACTURE OF TWISTLESS OR SUBSTANTIALLY TWISTLESS YARN AND THE YARN OBTAINED ACCORDING TO THIS PROCESS

[75] Inventors: Jacob K. Smid, Bodegraven; Thomas H. M. Terwee, Wierden, both of Netherlands

[73] Assignee: Chem-Y Fabriek Van Chemische Producten, BV, Bodegraven, Netherlands

[21] Appl. No.: 190,253

[22] Filed: Sep. 24, 1980

[30] Foreign Application Priority Data

Sep. 28, 1979 [NL] Netherlands ..... 7907209

[51] Int. Cl.[3] ..... D02G 3/40; D01H 13/30

[52] U.S. Cl. ..... 57/286; 57/295; 57/296; 57/297; 57/298

[58] Field of Search ..... 57/295–298, 57/286, 292; 28/178; 156/148

[56] References Cited

U.S. PATENT DOCUMENTS

| | | | |
|---|---|---|---|
| 2,169,269 | 8/1939 | McNally | 57/292 |
| 2,799,914 | 7/1957 | Nickerson | 28/178 X |
| 2,965,518 | 12/1960 | Meisel | 28/178 X |
| 3,040,413 | 6/1962 | Marzocchi et al. | 57/298 X |
| 3,447,310 | 6/1969 | Bok et al. | 57/298 X |
| 4,038,813 | 8/1977 | Heap | 57/298 X |
| 4,107,914 | 8/1978 | Van Dort | 57/298 X |
| 4,115,992 | 9/1978 | Van Tijn | 57/298 X |
| 4,228,643 | 10/1980 | Nijhuis et al. | 57/298 X |

*Primary Examiner*—Donald Watkins

[57] ABSTRACT

A method of manufacturing twistless or substantially twistless yarn consisting of dry drafting a sliver, moistening the drafted sliver with a water-soluble cation-active polymer bonding agent, drafting the sliver in the web state, false twisting the sliver, activating the bonding agent by drying the sliver on a heated drum and winding the resultant yarn up on cross wound cheeses, and a yarn manufactured according to this process.

5 Claims, 1 Drawing Figure

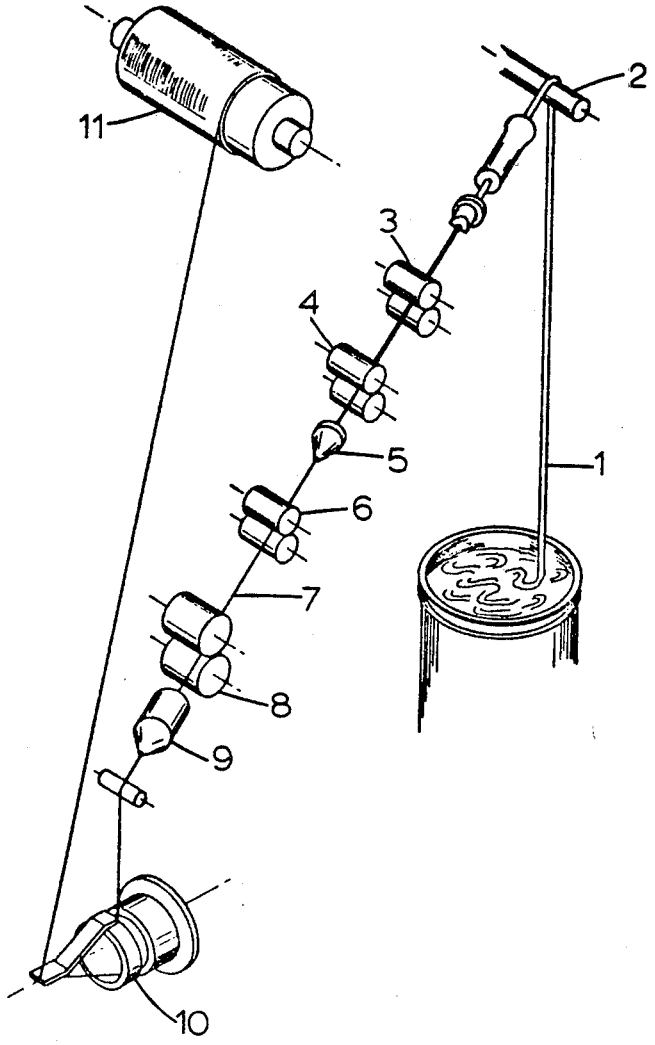
11
2
3
4
5
1
6
7
8
9
10

PROCESS FOR THE MANUFACTURE OF TWISTLESS OR SUBSTANTIALLY TWISTLESS YARN AND THE YARN OBTAINED ACCORDING TO THIS PROCESS

BACKGROUND OF THE INVENTION

This invention relates to a process for the manufacture of twistless or substantially twistless yarn and the yarn obtained according to this process. For this purpose, a sliver of staple fiber is drafted to form a thinner fiber strand, the fiber strand is false twisted and bonded with the aid of a bonding agent which can be removed from products manufactured using the twistless yarn.

A prior process is known from U.S. Pat. No. 3,447,310. In that process the sliver is, before, during or after drafting, but before false twisting, washed in an unsaturated wet state with an excess of starch granules in suspension. After false twisting, the fiber strand is subjected to heat treatment which activates that bonding agent and thereafter the fiber strand is dried.

Slivers composed of predominately hydrophilic fibers absorb sufficient quantitites of the bonding agent yielding a yarn of sufficient and uniform strength. Thus, for example, cotton fibers can be processed according to that known method, only after bleaching, scouring and/or soaking for several days in water.

It is an object of the present invention to provide an improved bonding process for both hydrophobic and hydrophilic fibers in fiber strands. For this purpose, a water-soluble cation-active polymer promotes fiber bonding. Consequently, cotton fibers no longer require prolonged pre-draft bleaching, scouring or soaking thereby decreasing process time. The cation-active bonding agent also decreases the soiling of process machinery.

Accordingly, the present invention provides a method for manufacturing hydrophobic or hydrophilic slivers into twistless or substantially twistless yarn using a removable water-soluble cation-active polymer bonding agent. Cation-active carbohydrates, such as quaternized starches with substitution degrees at between about 0.005 and 0.500 are suitable water soluble cation-active polymer bonding agents for use herein.

BRIEF DESCRIPTION OF THE DRAWING

The drawing schematically illustrates one preferred embodiment of the twistless spinning process in the practice of the present invention employing inactive bonding agents.

DETAILED DESCRIPTION OF THE INVENTION

A sliver of staple fiber is used as starting material. This sliver is first drafted to a thinner fiber strand. Drafting can then take place in both the dry and wet state. Preferably, the drafting units used are composed of two drafting zones, separated by a neutral zone as described in the Netherlands patent application 78-03705. In the first zone, drafting takes place in the dry state and in the second zone in the wet state. The liquid required for drafting the sliver in the second zone can be applied to the sliver by a false-twist member placed in the neutral zone. Placing the false twise member in the neutral zone permits simultaneous application of the bonding agent and drafting liquid to the sliver. If use is made of a single drafting unit or of a drafting unit composed of two drafting zones coupled to one another, then the bonding agent can be added in the manner described in U.S. Pat. No. 3,447,310 referred to above.

After drafting, the resulting fiber strand is false twisted and then bonded using a bonding agent that is removable from the products manufactured from the twistless yarn. Inactive bonding agents are preferable. The bonding process consists of activating the bonding agent, followed by drying. The activation of inactive bonding agents is described, for instance, in "Chemiefasern/Textilindustrie, September 1979, p. 738".

Should the amount of moisture in the fiber strand be insufficient for an adequate activation of the bonding agent, then additional moisture can be supplied after false twisting, but prior to the actual activation, for example, in the manner described in U.S. Pat. No. 4,007,580.

Activation itself can be carried out in the manner described in U.S. Pat. No. 4,051,658. This patent discloses that the inactive bonding agent in the fiber strand can be activated by direct contact with a heated drum, the fiber strand being for this purpose passed a number of times around this drum. The manufacture of twistless yarn occurs at high speed and consequently to reduce the number of windings around the drum, the activation time of the bonding agent should preferably remain below 5 seconds.

The water-soluble cation-active polymer required for bonding in accordance with the present invention can be obtained, for example, by treating a polymer with functional groups, such as alcohol, carboxyl, amido and amino groups as regularly recurring structural elements with a cationizing reagent (see, for example, Wochenblatt fur Papierfabrikation, Vol. 18, 1978, pp. 690–693). Suitable polymers include carbohydrates, polyvinyl alcohol, polyacrylic acid, carboxymethyl cellulose, polyacrylamide, polyaminoamides, polyimines and polyamides. Preferably cation-active carbohydrates, cation-active starches in particular, are used as the the polymer bonding agent, since carbohydrates are easily converted into the desired cation-active form (see, for example, R. L. Whistler, E. F. Paschall "Starch: Chemistry and Technology", Part II, pp. 403–414). Moreover, these bonding agents are bio-degradable.

Quaternized starch is most suitable as a cation-active starch. For example, reacting starch with a quaternizing reagent, e.g., quaternary-substituted ammonium compounds, as described in U.S. Pat. No. 4,088,600 yields a suitable quaternized starch.

The degree of substitution of the quaternized starch, i.e., the number of moles of quaternary substituent per mol anhydro glucose unit in the starch, can be varied. Good results are obtained using a quaternized starch with a substitution degree of between about 0.005 and 0.5. Carrying out the starch quaternization with glycidyl trimethyl ammonium chloride yields a bonding agent with particularly low impurity content.

DETAILED DESCRIPTION OF THE DRAWING

The drawing schematically illustrates the overall process of the instant invention. A sliver of textile material 1 is pulled over guiding element 2, drafted in the dry state between rollers 3 and 4, moistened with the inactive bonding agent suspended in water 5, drawn through roller 6 and drafted in the wet state 7, drawn through roller 8, false twisted with steam 9, dried on heated drum 10 thereby activating the bonding agent, and then wound up on cylindrical cross wound cheeses 11.

PREPARATION OF THE PREFERRED BONDING AGENT

Corn starch, 1136 grams of particle size 3–30 μm with 12 weight % water, is dispersed in 1500 g demineralized water at room temperature. Then after adding 100 grams Ogtac 85 (a commercially available 85 weight % aqueous solution of glycidyl trimethyl ammonium chloride, epoxide content 5.08 meg/g) 16 g NaOH in 320 g water are slowly added with thorough stirring. The resultant suspension is then heated in a 45° C. waterbath while stirring thoroughly. The mixture reacts at 45° C. for 12 hours, after which the resultant slurry is carefully neutralized with dilute hydrochloric acid (18 weight %) to a pH of about 4. After diluting with water of the resultant slurry the diluted slurry can be used in twistless yarn manufacture. Filtering the resultant slurry, drying the filter cake and grinding the dried product yields solid material suitable for transport and shipment. The resultant quaternized starch has a substitution degree of 0.053 (determined by Kjeldahl nitrogen analysis). Other types of starch may be similarly quarternized, for example, potato starch, wheat starch, tapioca starch and rice starch.

EXAMPLES

1. A sliver of 5 ktex consisting of combed cotton fibers averaging 30 mm in length, was successively drafted five-fold in the dry state, moistened with a 5 weight % suspension of an inactive bonding agent in water, drafted twenty-fold in the wet state, false twisted with steam, after which the bonding agent was activated and the sliver was dried on a drum heated to 220° C. The resultant yarn was then wound up at a speed of 250 m/min. This process was repeated with viscous rayon fibers, HMW viscous rayon fibers and polyester fibers, all of 1.7 dtex and 40 mm fiber length.

Using quaternized corn starch with substitution degree 0.053 yielded cotton, viscous rayon, HWW viscous rayon and polyester yarns with respective tenacities of 10.3, 11.5, 18.4 and 20.2 g/tex.

Using quaternized corn starch with substitution degree 0.015 yielded cotton, viscous rayon and HMW viscous rayon yarns with respective tenacities of 3.8, 10.7 and 17.9 g/tex. The polyester sliver would not be processed using the bonding agent with substitution degree 0.015.

Using quaternized corn starch with a substitution degree 0.097 yielded cotton, viscous rayon, HMW viscous rayon and polyester yarns with respective tenacities of 10.7, 14.0, 20.0 and 21.3 g/tex.

Using unquaternized corn starch, i.e., a substitution degree of 0, yielded cotton, viscous rayon and HMW viscous rayon yarns with respective tenacities of 3.6, 13.3 and 17.6 g/tex. Once again, the polyester sliver could not be processed.

These examples show that using quaternized starches with high substitution degrees markedly increases hydrophobic yarn tenacity. For example, comparing the results obtained from treating cotton with quarternized corn starch with substitution degrees of 0.015 and 0.053 shows a 171% increase in tenacity. Using unsubstituted starches or starches with low substitution degrees yielded hydrophobic yarns with litte or no tenacity. The effects are less pronounced on hydrophilic yarns.

2. Using quaternized potato starch with substitution degree 0.017 in the process in example 1, yielded cotton and polyester yarns with respective tenacities of 4.3 and 19.0 g/tex. The polyester yarn tenacity increased from 0 (using the corn starch with substitution degree 0.015) to 19 g/tex. using potato starch with substitution degree 0.017.

The desired starch substitution degree consequently remains highly dependent on the starch type used. The dissolving-temperature of the bonding agent determines the upper limit of the starch substitution degree.

In general, only cation-active polymers with substitution degrees resulting in dissolving temperatures above room temperature can be used. Below room temperature, we can no longer speak of an inactive bonding agent. Active bonding agents often cause undesired soiling of process machinery thereby increasing the chances for breaking the sliver during processing.

While the invention has been herein shown and described in what is presently conceived to be the most preferred and practical embodiment thereof, it will be apparent to those of ordinary skill in the art that many modifications may be made thereof within the scope of the invention, which scope is to be accorded the broadest interpretation of the appended claims as to encompass all equivalent methods and procedures.

What is claimed is:

1. In processes for the manufacture of twistless or substantially twistless yarn which comprises drafting a sliver of staple fiber to a thinner fiber strand, false twisting the fiber strand and bonding it with the aid of a bonding agent, which bonding agent can be removed from products manufactured using the twistless yarn, the improvement consisting essentially in employing a water-soluble cation-active quaternized starch polymer as the bonding agent.

2. A process for the manufacture of twistless or substantially twistless yarn according to claim 1, wherein said quaternized starch has a degree of substitution of between 0.005 and 0.5.

3. A process for the manufacture of twistless or substantially twistless yarn according to claim 2, wherein said starch is quaternized with glycidyl trimethyl ammonium chloride.

4. A process for the manufacture of twistless or substantially twistless yarn according to any one of claims 1, or 2 wherein a bonding agent with an activation time of 5 seconds or less is used.

5. A twistless or substantially twistless yarn manufactured by drafting a sliver of staple fiber to a thinner fiber strand, false twisting the fiber strand and bonding it with the aid of a water-soluble cation-active quarternized starch polymer bonding agent, which agent can be removed from the final product.

* * * * *